United States Patent [19]

Nakazawa et al.

[11] 4,224,917

[45] Sep. 30, 1980

[54] IGNITION DEVICE

[75] Inventors: Terumi Nakazawa; Hitoshi Minorikawa; Kazutoshi Kobayashi; Hiromitsu Nagae; Tomoji Inui, all of Ibaraki, Japan

[73] Assignee: Hitachi, Ltd., Japan

[21] Appl. No.: 873,772

[22] Filed: Jan. 31, 1978

[30] Foreign Application Priority Data

Feb. 2, 1977 [JP] Japan ..... 52-9699

[51] Int. Cl.[2] ..... F02P 7/00

[52] U.S. Cl. ..... 123/647; 123/146.5 A

[58] Field of Search ..... 123/148 E, 146.5 A, 123/148 R, 198 E; 200/19 R, 27 A; 339/276 F, 276 T, 211

[56] References Cited

U.S. PATENT DOCUMENTS

| | | | |
|---|---|---|---|
| 1,378,833 | 5/1921 | Bokemeyer | 123/146.5 A |
| 3,277,340 | 10/1966 | Jukes et al. | 123/148 E |
| 3,396,249 | 8/1968 | Kind et al. | 200/19 R |
| 3,581,725 | 6/1971 | Hemphill et al. | 123/148 E |
| 3,888,225 | 6/1975 | Boyer et al. | 123/148 E |
| 3,906,918 | 9/1975 | Longstaff-Tyrrell | 123/148 E |
| 3,915,542 | 10/1975 | Schau-Kjeldsen | 123/148 E |
| 3,996,914 | 12/1976 | Crall et al. | 123/198 E |

*Primary Examiner*—Charles J. Myhre
*Assistant Examiner*—Andrew M. Dolinar
*Attorney, Agent, or Firm*—Craig & Antonelli

[57] ABSTRACT

This invention relates to an ignition device of the type wherein a pickup coil for making a signal synchronous with the engine revolution is disposed within a distributor, an amplifier circuit for amplifying the output of the pickup coil and a power transistor for controlling the primary coil current of an ignition coil are arranged in a circuit unit under hybrid IC and chip states respectively, and the circuit unit is mounted on a side surface of a housing of the distributor.

A highly waterproof structure has been found necessary in order that the insulation between the housing and pickup terminals as well as connectors for coupling the pickup coil and the amplifier circuit and the insulation between the terminals may be prevented from degrading due to moisture.

To this end, a protuberance which projects from the circuit unit into the housing is disposed in a manner to surround the pickup terminals.

5 Claims, 11 Drawing Figures

IGNITION DEVICE

BACKGROUND OF THE INVENTION

1. Field of the Invention

This invention relates to a contactless ignition device, and more particularly to a contactless ignition device of excellent waterproof property which is suitable for use in automobiles etc.

2. Description of the Prior Art

Heretofore, contactless ignition devices have been such that an induced voltage is obtained from a signal generator for generating a signal synchronous with the engine revolution, that the voltage is processed by electronic circuitry, and that a high voltage is produced in an ignition coil according to the number of revolutions. In some of such contactless ignition devices, the electronic circuitry is mounted directly on the proper of a distributor so as to reduce the numbers of man-hours in assemblage and in interconnections. The electrical couplings between the electronic circuitry and other equipments are made by the use of connectors. However, when a waterdrop or the like adheres between the terminals of the connectors, especially between the connector terminals across which an output from the signal generator is applied, a distortion in the signal waveform or a lowering in the output voltage arises due to leakage, with the result that the ignition point deviates from the optimum value or that energy to be supplied from the ignition coil to an ignition plug becomes insufficient. In the prior-art ignition devices, therefore, the amplifier circuit and the signal generator are coupled by lead wires.

Such techniques are disclosed in Japanese Utility Model Application Publication No. 49-33615 and Application Publication No. 49-33623.

Further, Japanese Utility Model Application Publication No. 46-17535 and Japanese Patent Application Laying-open No. 52-22639 teach expedients in which the amplifier circuit is mounted on a side surface of a housing of the distributor. With such methods, however, the connection between a pickup coil and a circuit unit is troublesome. When the circuit unit has lead wires, the fabrication is inconvenient. On the other hand, when it is connected by the use of connectors, malfunctions occur due to a waterdrop.

SUMMARY OF THE INVENTION

Object of the Invention

An object of this invention is to provide an ignition device in which terminals and connectors for connecting a signal generator and a signal amplifier circuit are put into a structure of excellent waterproof effect.

Statement of the Invention

According to this invention, a signal generator is arranged within a distributor, an amplifier circuit for amplifying an output of the signal generator and a power transistor for controlling a primary coil current of an ignition coil are arranged in a circuit unit, the circuit unit is mounted on a side surface of the distributor, and a protuberance is disposed which projects in a manner to protrude into the distributor and which surrounds pickup terminals for coupling the amplifier circuit and the signal generator.

DESCRIPTION OF THE PREFERRED EMBODIMENTS

Figure 1:
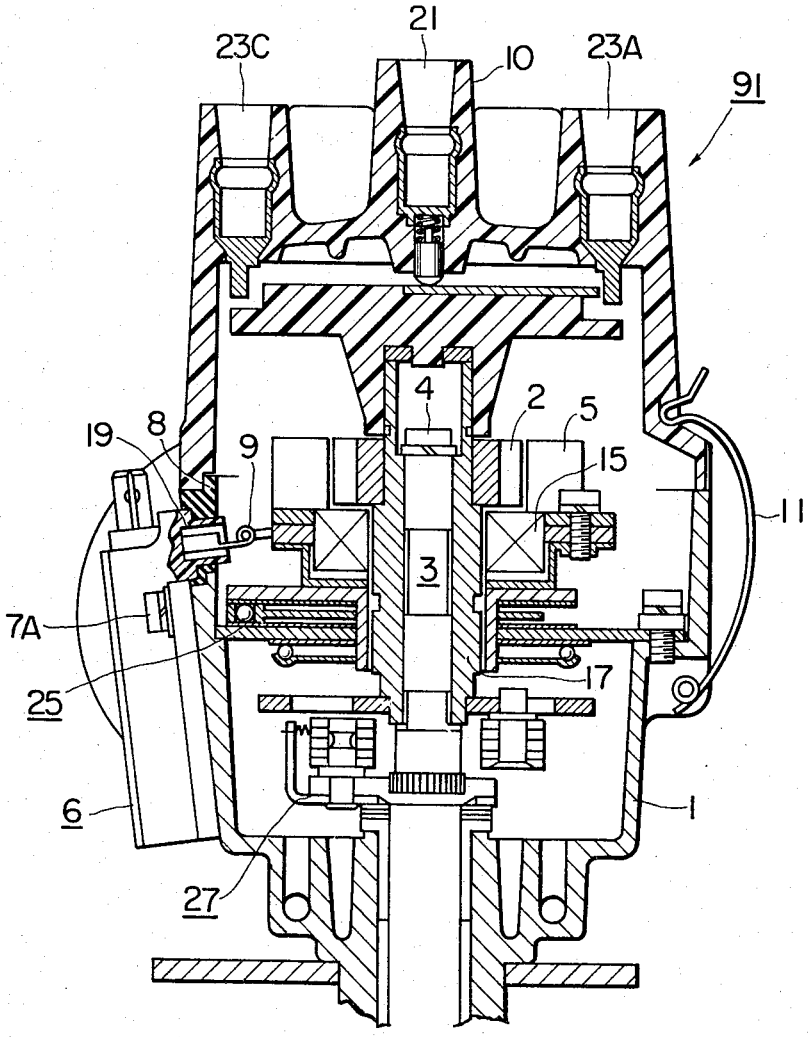
FIG. 1 is a sectional view showing the state under which a circuit unit is mounted on a side surface of a distributor.

FIG. 1 is a sectional side elevation showing an embodiment of this invention.

A rotor 2 which is assembled in a housing 1 of a distributor 91 is fixed to a shaft 3 by a screw 4 through a slide shaft 17 disposed on the outer periphery of the shaft 3. It is rotated by the revolution of an engine. Magnetic poles 5 are assembled in opposition to the rotor 2. Under the magnetic poles 5, a pickup coil 15 is disposed. The magnetic reluctance between the rotor 2 and the magnetic poles 5 varies in response to the rotation of the rotor 2, whereby a voltage is induced in the pickup coil 15. The magnetic poles 5, the pickup coil 15 and the rotor 2 constitute a signal generator.

Figure 2:
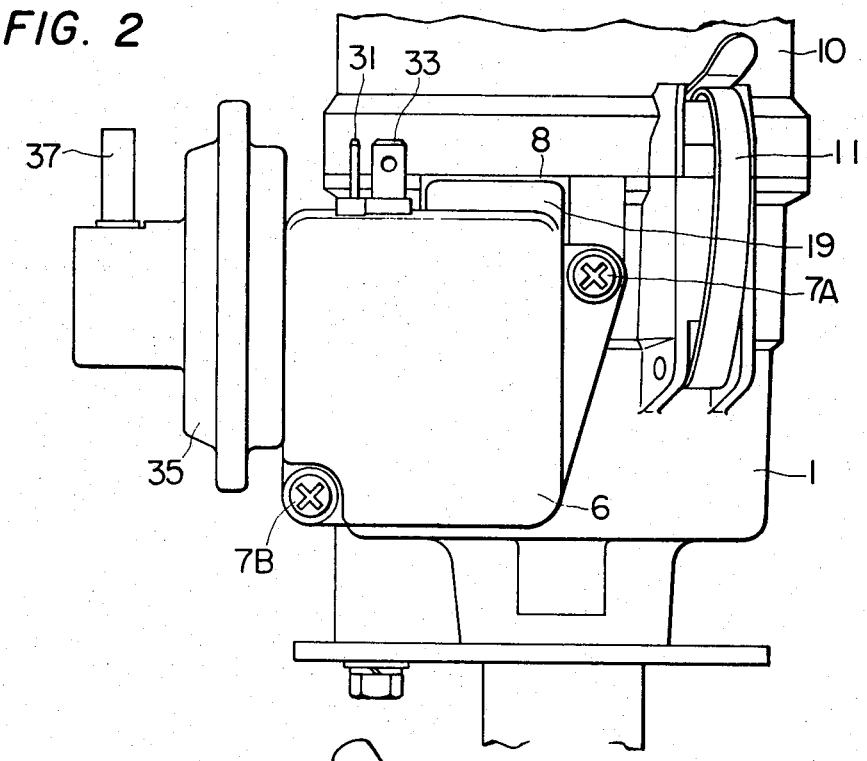
FIG. 2 is a front view corresponding to FIG. 1.

A circuit unit 6 is fixed to the housing 1 of the distributor 91 by screws 7A and 7B (seen in FIG. 2). Within the circuit unit 6, an amplifier circuit for amplifying the output of the pickup coil 15 is encased in the form of a hybrid IC. Further, a power transistor for controlling the primary coil current of an ignition coil is encased under a chip state.

The circuit unit 6 is provided with a protuberance 19, around which a packing 8 made of rubber or the like is disposed. The packing 8 functions to enhance the waterproofness between a cut-away portion or aperture of the housing 1 and the protuberance 19. When a cap 10 is put on and is fixed by a clamp 11, the waterproofness between the packing 8 and the cap 10 is also enhanced by the compressive force of the clamp 11.

The cap 10 is provided with a center electrode 21 as a high voltage terminal and side electrodes 23A–23D. In the figure, numeral 25 designates a negative pressure angle advancing mechanism, and numeral 27 a centrifugal angle advancing mechanism.

FIG. 2 shows the distributor 91 as viewed from the front of the circuit unit 6 in order to clearly illustrate the shape of the unit 6 in FIG. 1, and has the upper part of the cap 10 broken away therefrom. The unit 6 is fixed to the housing 1 by the screws 7A and 7B. Around the protuberance 19 of the unit 6, the packing 8 made of rubber or the like is disposed. Further, a coil terminal 31 and a power supply terminal 33 are disposed on the same side of the unit 6 as that of the protuberance 19. The coil terminal 31 is connected with the primary coil of an ignition coil (not shown), while the power supply terminal 33 is connected with a d.c. power source such as battery means. Shown at 35 is a diaphragm for the negative pressure angle advancing. A negative pressure suction port 37 is joined with an intake manifold of the engine.

Figure 3:
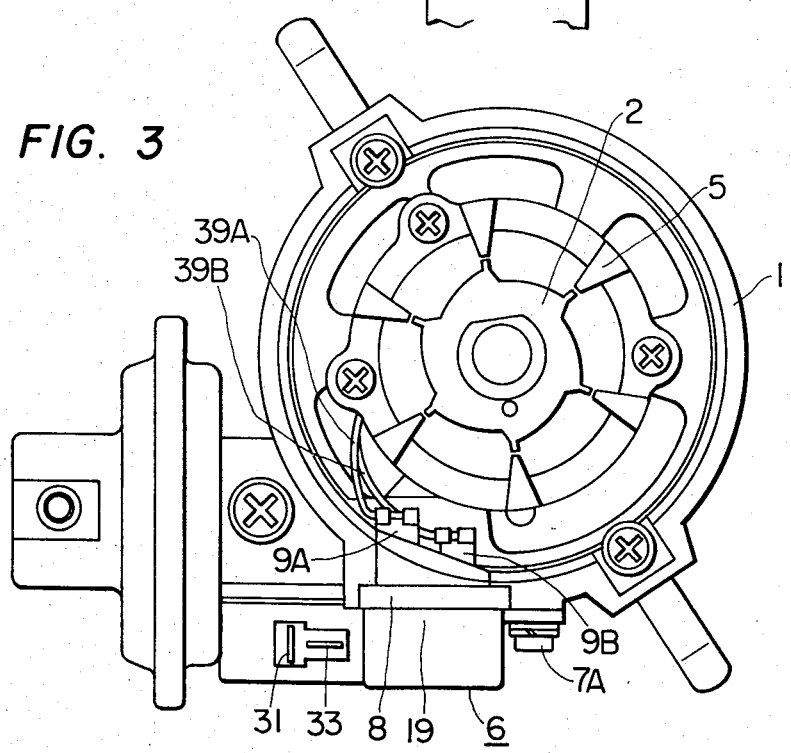
FIG. 3 is a top view under the state under which a cap in FIG. 1 is removed.

FIG. 3 shows the distributor 91 under the state under which it is viewed from above with the cap 10 in FIG. 2 taken off. As explained with reference to the section in FIG. 1, the rotor 2 and the opposing magnetic poles 5 are disposed within the housing 1, and the pickup coil 15 is arranged under the rotor 2.

The circuit unit 6 is mounted on the side surface of the housing 1 by the screws 7A and 7B. The protuberance 19 has its periphery surrounded by the packing 8 of rubber or the like. Although pickup terminals are disposed within the protuberance 19, they are not seen in FIG. 3. Connectors 9A and 9B for connecting the pickup terminals and the pickup coil are connected as shown in the figure, and under this state, their end parts jut out of the packing. The pickup connectors 9A and 9B are joined with the pickup coil by lead wires 39A and 39B.

Figure 5:
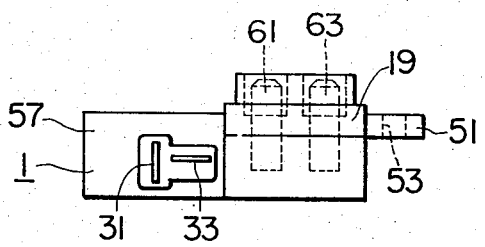
FIG. 5 is a top view of the circuit unit.
Figure 4:
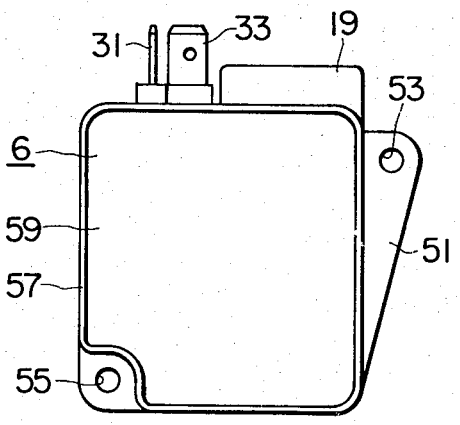
FIG. 4 is a front view of the circuit unit.
Figure 6:
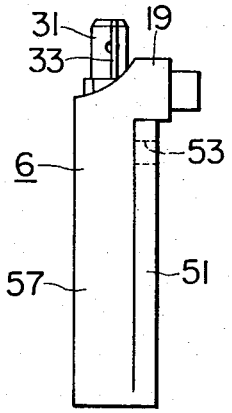
FIG. 6 is a right side view of the circuit unit.

FIGS. 4, 5 and 6 are views showing the outward shapes of the circuit unit 6. An alumina substrate 51 having screw holes 53 and 55 is provided with an outer frame 57 having the protuberance 19. A lid 59 is airtightly secured to the outer frame 57 by bonding. The coil terminal 31, the power supply terminal 33, and the pickup terminals 61 and 63 are disposed on one side of the outer frame 57. The pickup terminals 61 and 63 are surrounded by the protuberance 19 made of a resin.

Figure 7:
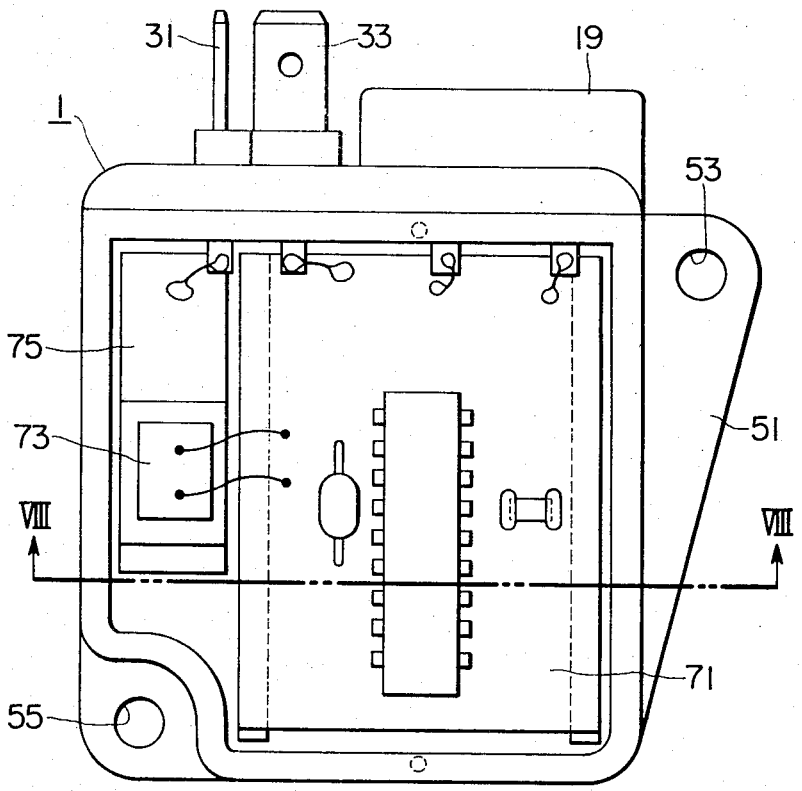
FIG. 7 is an arrangement plan showing the interior of the circuit unit.
Figure 8:
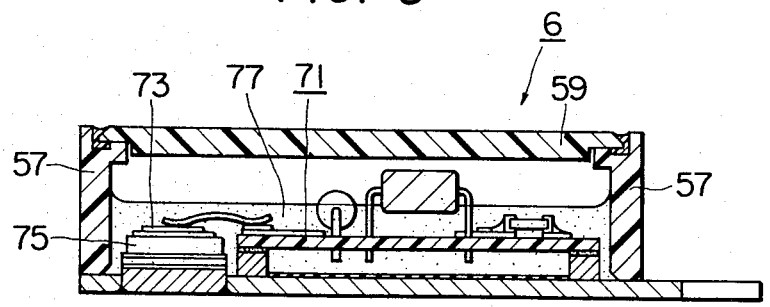
FIG. 8 is a sectional view taken along line VIII—VIII in FIG. 7.

FIG. 7 illustrates the state under which the lid 59 is taken off in FIG. 4, and it is a view enlarged to double the size of FIG. 4. FIG. 8 is a sectional view taken along line VIII—VIII in FIG. 7.

The interior of the circuit unit 6 is seen from FIGS. 7 and 8. The ignition signal is entered through the pickup terminals 61 and 63 (FIG. 5) by the hybrid IC 71. This ignition signal is detected and amplified, and the resultant output controls the base current of the power transistor 73 in the chip state. Shown at 75 is a heat sink of copper which is secured to the collector of the power transistor 73, and which is connected to the coil terminal 31. The interior of the unit 6 is filled with a silicone resin 77.

Figure 9:
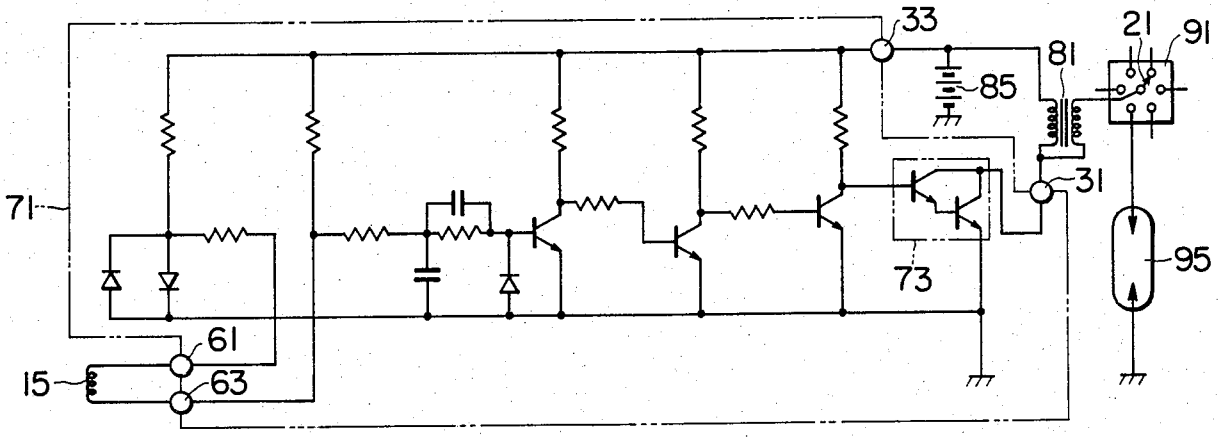
FIG. 9 is a diagram of an ignition circuit.

FIG. 9 shows an ignition circuit which has already been known. A circuit arrangement which applies this circuit is disclosed in U.S. Pat. No. 4,030,469 issued June 21, 1977. The output of the pickup coil 15 is entered through the connectors 61 and 63, amplified by the amplifier circuit 71 and drives the chip of the power transistor 73. The power supply terminal 33 connects the amplifier circuit and the batteries being the d.c. power source, while the connector 31 connects the collector of the chip of the power transistor and the primary coil of the ignition coil 81. The high voltage induced in the secondary coil of the ignition coil 81 is distributed to respective ignition plugs 95 through the distributor 91.

As explained above, in the embodiment illustrated in FIGS. 1 to 7, the pickup terminals 61 and 63 project into the distributor, and the insulator protrudes in a manner to surround the periperies thereof, so that a waterdrop can be prevented from adhering to the pickup terminals. Thus, the insulating resistances between the pickup terminals and between them and the distributor housing can be maintained.

Figure 10:
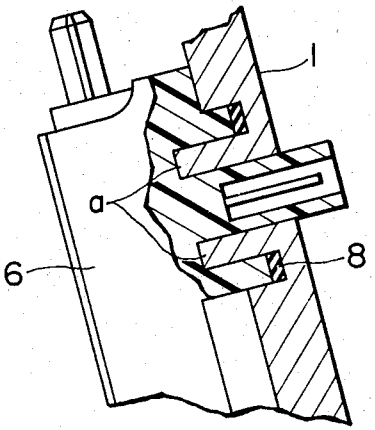
FIG. 10 is a schematic sectional view showing another embodiment of a protuberance of the circuit unit.

FIG. 10 is a sectional side elevation showing another embodiment of this invention. The difference of the present embodiment from the preceding embodiment shown in FIG. 1 is that a protuberance a is provided in the distributor housing 1. The protuberance a protrudes into the input signal terminal portion of the circuit unit 6. This protrusion forms a double structure together with the protrusion of the input signal terminal portion of the circuit unit 6, whereby the waterproof effect is further enhanced.

Figure 11:
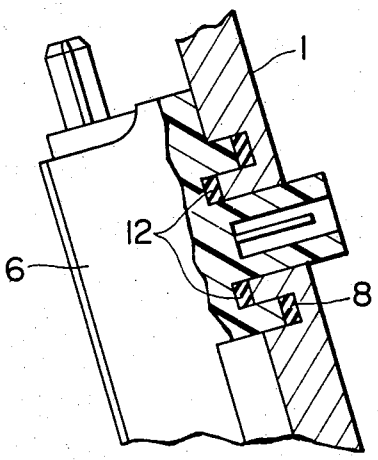
FIG. 11 shows still another embodiment of the protuberance of the circuit unit.

FIG. 11 is a sectional side elevation showing still another embodiment of this invention. The present embodiment is such that the height of the protuberance a of the embodiment shown in FIG. 10 is made the same as that of the inner surface of the distributor housing 1 so as to receive a packing 12 on the inner surface. According to the present embodiment, the waterproof property can be enhanced more than in the embodiment shown in FIG. 10.

In the embodiments of this invention illustrated in FIGS. 1 to 11, the input signal terminal portion juts into the distributor housing 1 as apparent from the figures. Therefore, in addition to the excellent waterproof property, it is prevented that connectors will come into contact with the distributor housing 1 and will cause short-circuits etc., so that the structure is also effective as an insulation box.

In the embodiment shown in FIG. 1, only the induced voltage type is exemplified as the signal generator. Needless to say, however, this invention is also applicable to a case of a photoelectric type signal generator employing light emitting diodes or the like.

As apparent from the foregoing, according to this invention, the structure of the connecting terminals of the input signal generator can be made the waterproof structure, with the result that a contactless ignition device having favorable ignition control characteristics can be provided.

What is claimed is:

1. In an ignition device comprising:

a signal generator means for generating a signal synchronous with the revolution of an engine;

amplifier means for detecting the output of the signal generator means and amplifying it;

a d.c. power source;

a power transistor which operates in response to an output of said amplifier means, an ignition coil which has at least a primary coil;

connection means for connecting said primary coil of said ignition coil and said power transistor in series with said d.c. power source so that a current flowing through said primary coil of said ignition coil can be controlled by the operation of said power transistor; and a distributor which distributes an output of a secondary coil of said ignition coil to respective ignition plugs of the engine;

said amplifier means detecting the output of said signal generator means, the resultant output operating said power transistor to control the primary coil current of said ignition coil and to produce a high voltage, said high voltage being distributed to the respective ignition plugs by said distributor;

the improvement therein comprising:

attachment means for mounting said signal generator means within said distributor so as to deliver the output in response to the operation of said distributor;

a circuit unit including waterproof housing means in which said power transistor and said amplifier means are arranged;

attachment means for mounting the waterproof housing means of said circuit unit on an outer surface of a housing of said distributor;

pickup terminals which project from said circuit unit into said distributor; and said waterproof housing means including a protuberance integral therewith which projects therefrom into an aperture of said distributor and which surrounds said pickup terminals;

said signal generator means and said amplifier means being connected through said pickup terminals whereby there results a highly waterproofed arrangement.

2. In the ignition device defined in claim 1, the improvement therein comprising the face that said distributor includes a cap on the distributor housing having high voltage terminals on an upper part thereof, that in said aperture as defined by a cut-away portion provided in said distributor housing in the vicinity of a snug fit portion between said housing and said cap, and that said pickup terminals and said protuberance are protruded into said housing through said cut-away portion.

3. In the ignition device defined in claim 2, the improvement therein comprising the fact that a packing is arranged on an outer periphery of said protuberance in said aperture.

4. In the ignition device defined in claim 2, the improvement therein comprising the fact that said housing means of said circuit unit is made substantially square and that said pickup terminals, an ignition coil terminal and a power supply terminal are arranged on one side surface of the square housing means.

5. In an ignition device comprising a distributor housing, signal generator means for generating a signal synchronous with the revolution of an engine, said signal generator means being positioned within said distributor housing, and amplifier means for detecting the output of the signal generator means and amplifying it, the improvement comprising, said amplifier means being provided in waterproof housing means attached to an outer side surface of the distributor housing, said waterproof housing means including a protuberance integral therewith which projects into an aperture of the distributor housing and which surrounds pickup terminals provided for connecting said signal generator means and said amplifier means whereby there results a highly waterproofed arrangement.

* * * * *